United States Patent [19]

Meijer

[11] Patent Number: 4,951,394

[45] Date of Patent: Aug. 28, 1990

[54] HAIR CUTTING UNIT

[75] Inventor: Albert J. Meijer, Drachten, Netherlands

[73] Assignee: U.S. Philips Corp., New York, N.Y.

[21] Appl. No.: 430,092

[22] Filed: Oct. 24, 1989

Related U.S. Application Data

[63] Continuation of Ser. No. 159,819, Feb. 24, 1988, abandoned.

[30] Foreign Application Priority Data

Mar. 4, 1987 [NL] Netherlands ..... 8700516

[51] Int. Cl.[5] ..... B26B 19/00

[52] U.S. Cl. ..... 30/223; 30/346.51

[58] Field of Search ..... 30/43, 43.91, 208, 223, 30/346.51

[56] References Cited

U.S. PATENT DOCUMENTS 4,563,814 1/1986 Trichell et al. ..... 30/223

*Primary Examiner*—Douglas D. Watts

*Attorney, Agent, or Firm*—Ernestine C. Bartlett

[57] ABSTRACT

The invention relates to a cutting unit for cutting hair, for example, as used in a shaver, comprising a first and a second cutting member, each having teeth and at least one cutting member that can be driven so as to perform a reciprocating movement with respect to the other cutting member, the second cutting member being present between the first cutting member and a locking member. The first cutting member and the locking member are connected together by means of spacers.

8 Claims, 1 Drawing Sheet

HAIR CUTTING UNIT

This is a continuation of application Ser. No. 159,819, filed Feb. 24, 1988, now abandoned.

FIELD OF THE INVENTION

The invention relates to a cutting unit for cutting hair as used, for example in a shaver, having a first and a second cutting member each comprising teeth and at least one of the cutting members can be driven so as to reciprocate with respect to the other cutting member, the second cutting member being present between the first cutting member and a locking member.

BACKGROUND OF THE INVENTION

Such a cutting unit is known, for example, from Netherlands Patent Application No. 7404738, (which corresponds substantially to U.S. Pat. No. 3,962,785). In this known construction the cutting members are forced on each other by means of a resilient element which is connected to the locking member. This pressure force is necessary to counteract those forces which occur instantaneously when a hair is cut and by which the cutting members would be urged apart. The pressure force of the resilient element of the known construction is present continuously and causes loss of energy and detrition of the moving parts.

SUMMARY OF THE INVENTION

An object of the invention is to avoid this disadvantage and the invention is characterized in that the first cutting member and the locking member are connected together by means of spacing members.

In special embodiments of the invention, spacers are present near the teeth of the cutting member and/or a second cutting member is present and the size of the spacers which determine the spacing between the first cutting member and the locking member corresponds to the thickness of the second cutting member.

The invention will now be described in greater detail with reference to a description of an embodiment shown in the Figures.

Figure 1:
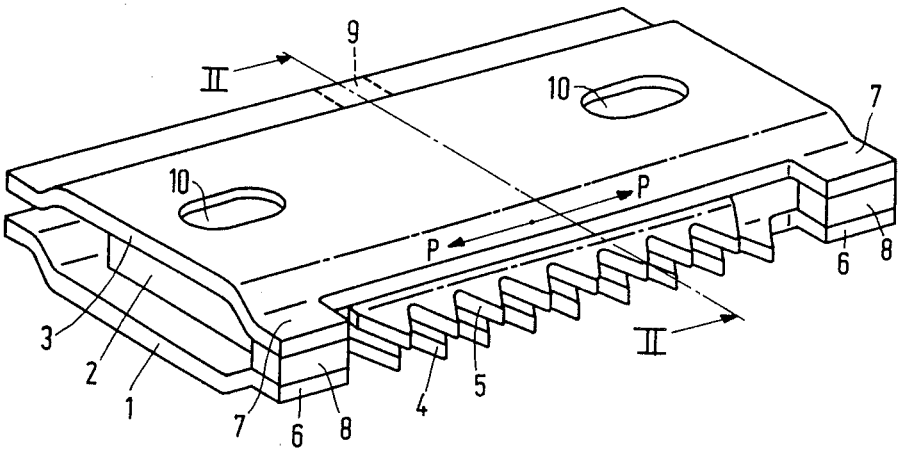
FIG. 1 is a perspective view of a cutting unit according to the invention.
Figure 2:
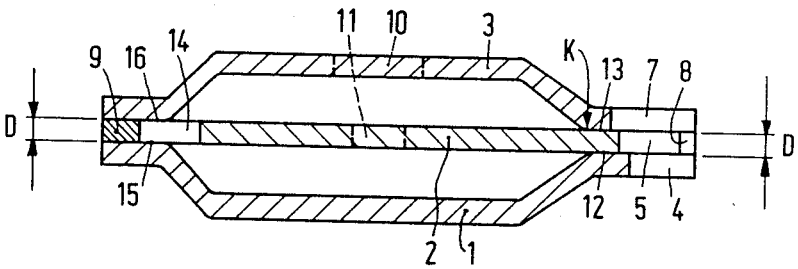
FIG. 2 is a sectional view taken on the line II—II of FIG. 1.

The cutting unit shown in FIGS. 1 and 2 comprises a first cutting member 1, a second cutting member 2 and a locking member 3. The cutting members 1 and 2 comprise teeth 4 and 5, respectively. The second cutting member 2 is present between the first cutting member 1 and the locking member 3 and can be driven so as to perform a reciprocating element in the directions of the arrow P with respect to the first cutting member by means of a driving mechanism known per se. Such a cutting unit is used, for example, in an apparatus for cutting long hair, a so-called trimmer, but it may also be used as an auxiliary tool in shavers.

The first cutting member 1 comprises lugs 6 which bound the row of teeth 4. The locking member 3 also comprises lugs 7 which are situated opposite to the lugs 6. A spacing member 8 is present between each pair of lugs 6 and 7. Moreover a corresponding spacing member 9 is present between the first cutting member 1 and the locking member 3 on the side of the cutting unit opposite to the teeth. The locking member 3 comprises elongate apertures 10 through which the second cutting member 2 can be driven. The second cutting member 2 comprises for this purpose corresponding coupling apertures 11. The first cutting member 1 and the locking member 3 and the spacers 8, 9 may be connected to form one assembly by means of known connection elements, for example bolt and nut connections. It is also possible to weld these components together or, in a detachable construction, to cause them to engage each other in a clamping manner by means of a resilient element. The spacers 8, 9 are in that case connected, for example, only to the first cutting member.

On the front of the cutting unit near the teeth 4, 5 the second cutting member 2 is present between the guide faces 12 and 13 on the first cutting member 1 and the locking member 3, respectively. On the oppositely located rear side of the cutting unit, on each side of spacer 9, protecting parts 14 of the second cutting member 2 are present (see also FIG. 3) between the guide faces 15 and 16 of the first cutting member 1 and the locking member 3, respectively.

The thickness D (FIG. 2) of the spacers 8, 9 is chosen to be so that the second cutting member 2 can reciprocate with a very small amount of play between the guide faces 12, 13 and 15, 16. The force K necessary to prevent the second cutting member 2 from being forced away from the first cutting member 1 during cutting a hair is exerted by the locking member 3 substantially via the guide face 13 on the second cutting member 2. This force K occurs only when this is necessary namely when a hair is cut, and is present in the most favorable place, namely near the teeth 4, 5. An extra resilient element for urging the cutting members together thus is superfluous in this construction and detrition and frictional losses are considerably reduced.

Figure 3:
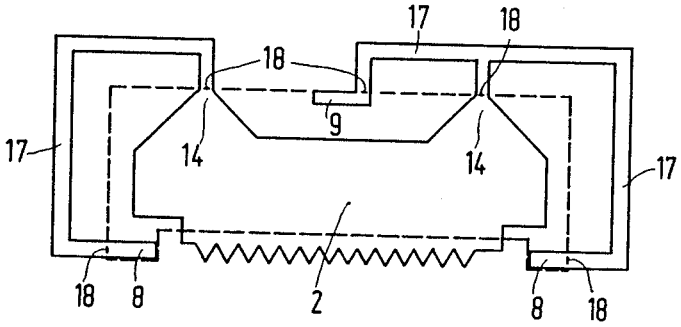
FIG. 3 is a plan view of a basic form of sheet material which comprises a cutting member and spacing members.

It is important for the thickness of the spacers 8, 9 to correspond as much as possible to the thickness of the cutting member 2. For this purpose the cutting member 2 and the spacers 8, 9 are preferably manufactured from the same basic form of sheet material. Such a basic form is shown in FIG. 3. The spacers 8, 9 are still connected to the second cutting member 2 by means of the arms 17. The locking member 3 is also shown in FIG. 3 by broken lines. As may be seen from the Figures the arms 17 are situated outside the contours of the locking member 3. The first cutting member 1, the locking member 3 and the basic form as shown in FIG. 3 can now be placed on top of each other and be welded together at the area of the spacers 8, 9. The arms projecting beyond the assembly may then be cut at 18. In this manner it is achieved that the thickness of the spacers 8, 9 corresponds accurately to the thickness of the second cutting member 2. After some running-in, if any, a light-running construction is obtained having very good cutting properties since the pressure force K will occur without the cutting members being urged apart substantially and a so-called cutting gap between the cutting members 1 and 2 will substantially not occur.

What is claimed is:

1. A cutting unit for cutting hair comprising a first and a second cutting member each comprising teeth, the second cutting member being driven so as to perform a reciprocating movement with respect to the other cutting member, the second cutting member being present between the first cutting member and a locking member, wherein the first cutting member and the locking member are connected together by means of spacers, the second cutting member reciprocating under a force that is discontinuously imposed on said second cutting member when hair is cut by the locking member.

2. A cutting unit as claimed in claim 1, with a second cutting member manufactured from sheet material, wherein in that the size of the spacers which determines the spacing between the first cutting member and the locking member corresponds to the thickness of the second cutting member.

3. A shaver, comprising a cutting unit as claimed in claim 1.

4. A cutting unit for cutting hair comprising a locking member, first and second cutting members each having a rearward and a forward edge and each having a plurality of teeth at the forward edge, the second cutting member being situated between said first cutting member and said locking member, the second cutting member being driven so as to perform a reciprocating movement with respect to the first cutting member, the first cutting member and locking member comprising pairs of first and second lugs, respectively adjoining the teeth on each side of the forward edge;

a first spacer between each pair of first and second lugs at the forward edge and a second spacer between the first cutting member and the locking member at the rearward edge;

first guide faces present on the first cutting member and on the locking member, respectively and adjoining the first spacer on the forward edge; and second guide faces present on the first cutting member and on the locking member respectively, and adjoining the second spacer on the rearward edge, the first cutting member and the locking member being connected by the first and second spacers at the forward and rearward edges, respectively;

the second cutting member at the forward edge being present between the first guide faces; and the locking member exerting a discontinuous force on the second cutting member through the first guide face present on the locking member when hair is cut.

5. A shaver, comprising a cutting unit as claimed in claim 4.

6. A cutting unit as claimed in claim 4 wherein, at its rearward edge, the second cutting member comprises protecting parts on each side of the spacers and between the guide faces of the first cutting member and the locking member, respectively.

7. A cutting unit as claimed in claim 4 wherein during the manufacture, the second cutting member is a part of a basic form of sheet material which also comprises the spacers, the thickness of the spacers corresponding to the thickness of the second cutting member.

8. A cutting unit as claimed in claim 7 wherein during the manufacture, the first cutting member, the locking member and the basic form comprising the second cutting member and the spacers are superimposed and welded together at the area of the spacers.

* * * * *